US005105593A

United States Patent [19]

Kaminaga et al.

[11] Patent Number: 5,105,593

[45] Date of Patent: Apr. 21, 1992

[54] WEATHERPROOF CURTAIN WALL UNIT

[75] Inventors: Hiromitsu Kaminaga, Urawa; Noriaki Okamoto, Yokohama; Yuichi Kano, Kawaguchi, all of Japan

[73] Assignee: YKK Architectural Products Inc., Japan

[21] Appl. No.: 690,359

[22] Filed: Apr. 24, 1991

[30] Foreign Application Priority Data

Apr. 25, 1990 [JP] Japan ..... 2-109814

[51] Int. Cl.[5] ..... E04B 2/88

[52] U.S. Cl. ..... 52/235; 52/397

[58] Field of Search ..... 52/235, 397, 488

[56] References Cited

U.S. PATENT DOCUMENTS 2,914,145 11/1959 Benson ..... 52/235

3,147,518 9/1964 Horgan, Jr. ..... 52/235

3,522,684 8/1970 Grossman ..... 52/235

3,553,918 1/1971 Dauson ..... 52/235

4,021,987 5/1977 Schnebel et aL. ..... 52/235

*Primary Examiner*—Richard E. Chilcot, Jr.

*Assistant Examiner*—Wynn Wood

*Attorney, Agent, or Firm*—Hill, Van Santen, Steadman & Simpson

[57] ABSTRACT

A weatherproof curtain wall unit (U) comprises a rectangular frame (F) enclosing a panel (P) therein and a resilient weatherstrip (A) provided at least along a pair of vertical sides and an upper side of the rectangular frame (F). The resilient weatherstrip (A) is offset between the vertical sides and the upper side to prevent a gap from arising between the resilient weatherstrips (A, A) of the adjacent curtain wall units (U1, U2, U3).

4 Claims, 4 Drawing Sheets

WEATHERPROOF CURTAIN WALL UNIT

BACKGROUND OF THE INVENTION

1. Field of the Invention

The present invention relates generally to a curtain wall unit to be attached to a building skeleton framework to construct a unit curtain wall and particularly to a curtain wall unit which is superior in weatherproofness.

2. Description of the Prior Art

A unit curtain wall includes a plurality of curtain wall units attached to a building skeleton framework such as slabs or vertical frame members in a checkerboard pattern. The curtain wall units thus attached have respective outer surfaces lying flush with each other and they are aligned vertically and horizontally into the checkerboard pattern. In order to prevent water from infiltrating into the interior, the conventional curtain wall unit has a resilient weatherstrip secured to and around the frame thereof, which weatherstrips have been prefabricated.

However, since the resilient weatherstrip is secured to the frame so as bend roundly at each corner, the resilient weatherstrips of each four adjacent curtain wall units will leave a gap in the juncture where their corners adjoin to each other. Since the conventional curtain wall unit is thus not entirely satisfactory in weatherproofness, watertightness at the junction has been desired at all times.

One attempt to solve the problem is disclosed in Japanese Patent Laid-open Publication No. 62-144311, wherein a kind of backing member is attached to the four adjacent curtain wall units on their rear sides at their juncture. Another attempt is disclosed in Japanese Utility Model Laid-open Publication No. 63-1120, wherein two pairs, vertical and horizontal pairs of weather strips are attached to the vertical and horizontal sides, respectively, of each curtain wall unit and the vertical and horizontal weather strips are joined together at each junction by a crisscross joint member.

However, either of the attempts has drawbacks in that a weak point lies in the junction between the weather strips and the backing member or the crisscross joint member and that the number of parts is increased, causing the cost of the curtain wall unit as a whole to increase and also causing the steps of installation of the unit curtain walls to increase.

SUMMARY OF THE INVENTION

With the foregoing difficulties in view, it is therefore an object of the present invention to provide a curtain wall unit in which high weatherproofness is ensured and which is simple in construction, less expensive and easy to install.

According to the present invention, there is provided a weatherproof curtain wall unit comprising: a rectangular frame having a pair of upper and lower horizontal frame members and a pair of vertical side frame members each connected at its opposite end with respective one ends of the upper and lower horizontal frame members to enclose a panel therein, each vertical side frame member having on its outside surface facing toward an adjacent curtain wall unit and outwardly of the inner edge thereof a vertical channel open toward the opposed vertical side frame member of the adjacent curtain wall unit, the vertical channel extending substantially throughout the length of the vertical side frame member but terminating slightly short of the upper end thereof, the upper horizontal frame member having on the inner edge thereof an upstanding inner side wall which in turn has on the upper edge thereof an upper horizontal channel open outwardly, the lower horizontal frame member having on the lower surface a vertical wall extending along and adjacent to the inner edge thereof; and a weatherstrip being of a continuous elongate resilient strip and comprising a pair of vertical strip portions fit in the respective vertical channels, a horizontal strip portion fit in the horizontal channel and a pair of offset portions each integrally joining the vertical strip portion and the horizontal strip portion; when the curtain wall unit is joined to curtain wall units adjacent horizontally and vertically thereto, each vertical strip portion and offset strip portion of the curtain wall unit coming into pressure engagement with the corresponding vertical strip portion and offset strip portion of the adjacent curtain wall unit and the horizontal portion of the unit curtain wall unit coming into pressure engagement with the inner surface of the vertical wall of the upper curtain wall unit.

The above and other objects, features and advantages of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION

Figure 1:
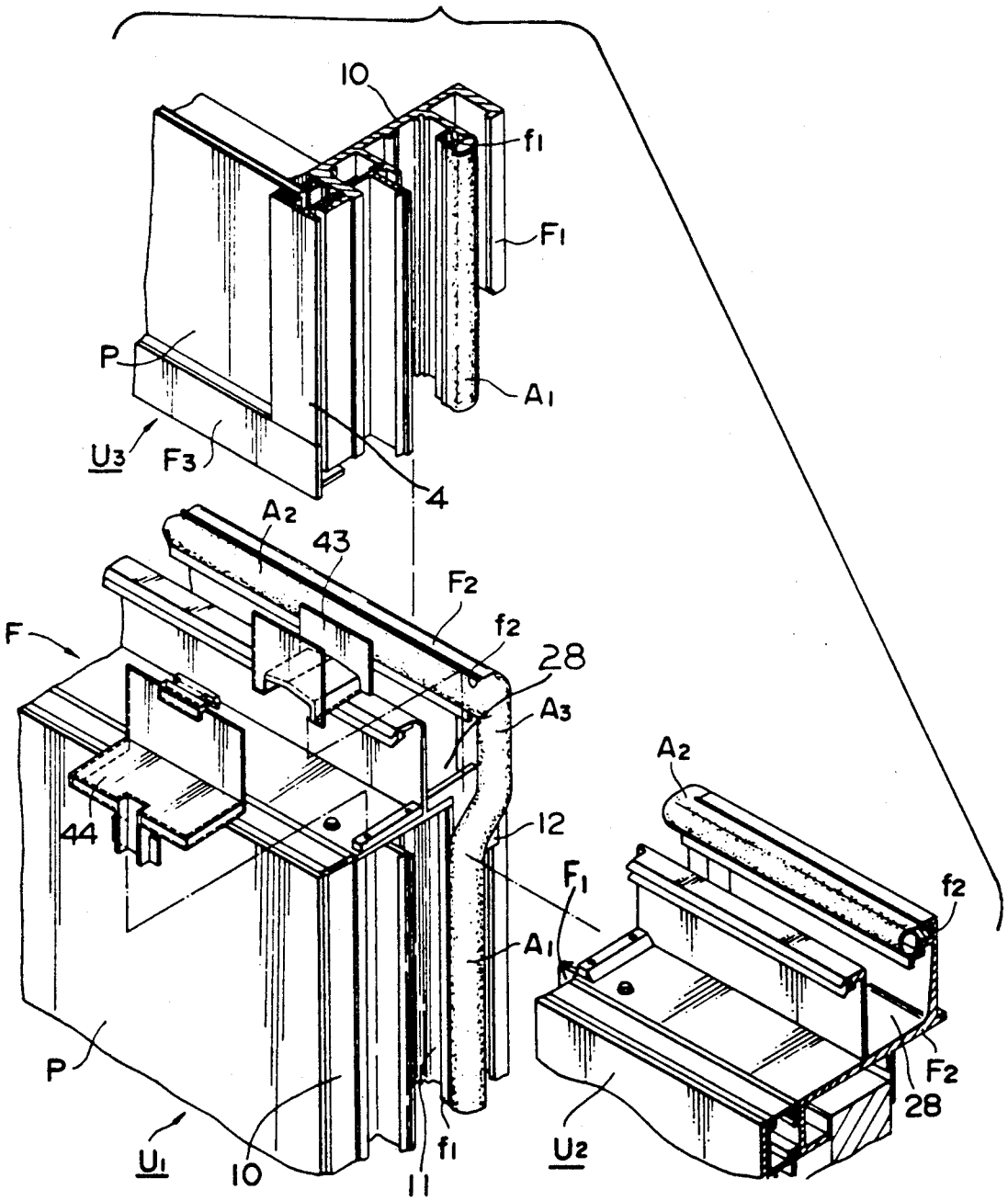
FIG. 1 is a fragmentary, exploded, perspective view of adjacent curtain wall units in juncture.

FIG. 1 shows three adjacent weatherproof curtain wall units U1, U2 and U3 according to the present invention to be separated from each other but ready for being assembled. Although only the three curtain wall units are shown in FIG. 1, a unit curtain wall includes a plurality of curtain wall units U1, U2, U3, . . . which are attached to a building skeleton framework so as to be arranged in a checkerboard pattern.

Each of the curtain wall units U broadly includes a rectangular frame 4 and a panel P mounted within a rectangular opening of the frame F. The frame F comprises a pair of vertical side frame members F1, F1 of metal and a pair of upper and lower horizontal frame members F2, F3 of metal each connected at its opposite ends to respective one ends of the vertical side frame members F1, F1.

Figure 2:
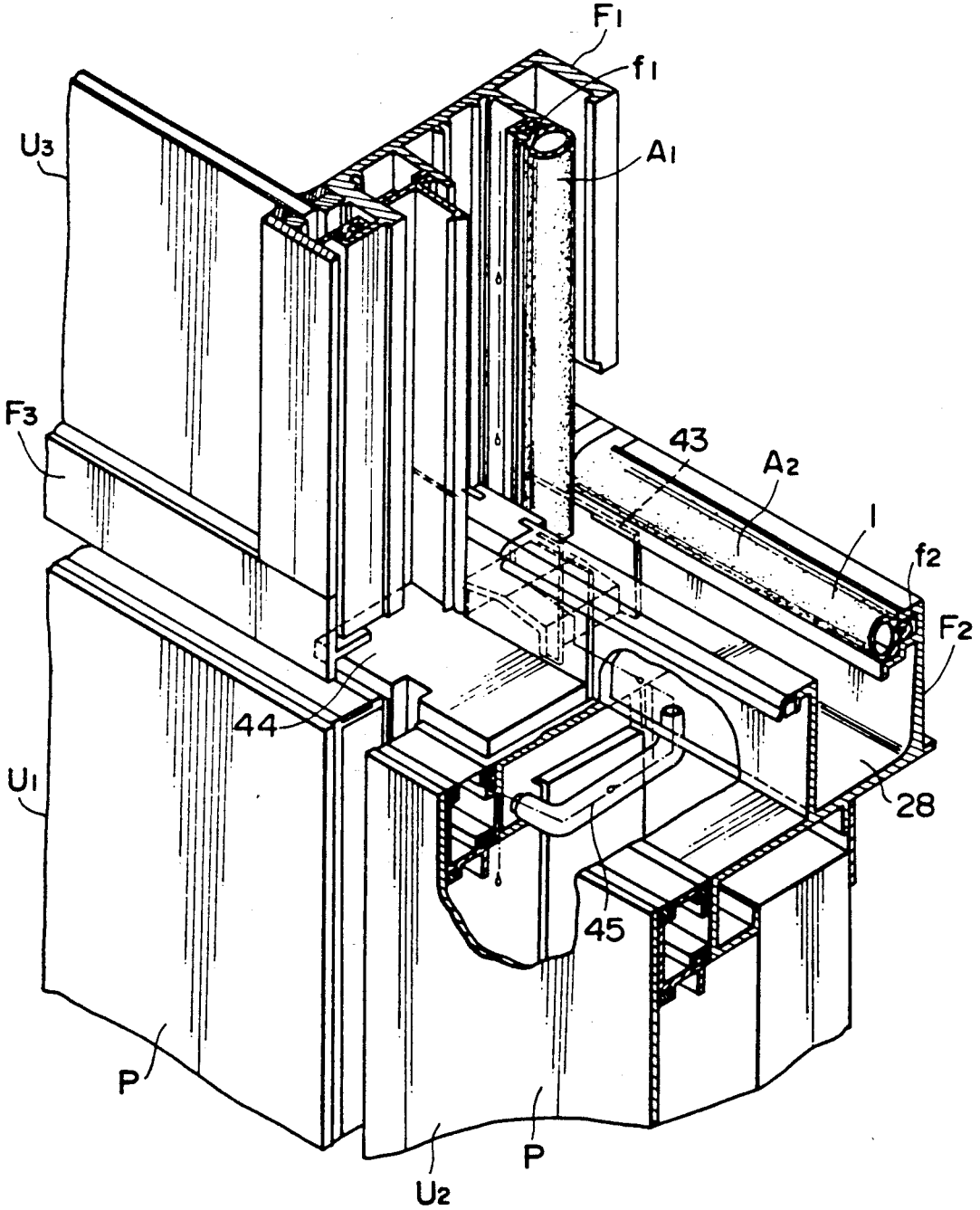
FIG. 2 is a view similar to FIG. 1 but showing the adjacent curtain wall units assembled.

As shown in FIGS. 1 and 2, each vertical side frame member F1 comprises a base plate 10 and an upstanding ridge 11 provided longitudinally on the outer surface facing toward the adjacent curtain wall unit U2 and slightly outwardly of the inner edge thereof. The upstanding ridge 11 extends substantially throughout the length of the side frame member F1 but terminates short of the upper end thereof. The upstanding ridge 11 has along the distal edge thereof a vertical channel f1 which is open toward the opposed vertical side frame member F1 of the adjacent curtain wall unit U2. The vertical side frame member F1 has also a protuberant guide stud 12 provided contiguous from the upper end of the vertical ridge 11 and intermediate between the vertical ridge 11 and the inner edge of the vertical side frame member F1.

Figure 4:
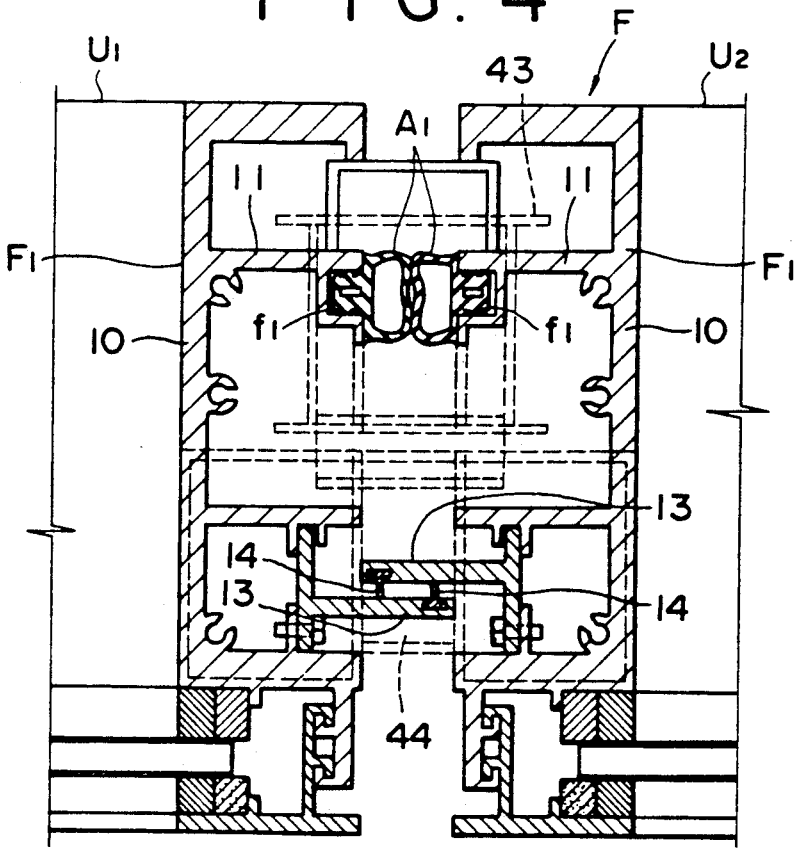
FIG. 4 is a horizontal cross-sectional view of the two adjacent curtain wall units horizontally adjacent to each other.

As better shown in FIG. 4, each vertical side frame member F1 also includes an elongated rib 13 provided longitudinally on the outside surface facing toward the adjacent curtain wall unit U2 and adjacent to the outer edge thereof. The elongate rib 13 is coextensive to the vertical ridge 11, is generally T-shaped in cross-section and has a crossbar secured to the outside surface and disposed parallel to the base plate 10 of the vertical side frame F1 and a web portion protruding perpendicularly therefrom toward the adjacent curtain wall unit U2. The web portion is slightly deviated from the center of the crossbar. A resilient elongated sealing strip 14 is provided on one side and adjacent to the distal end of the perpendicular web portion.

Figure 5:
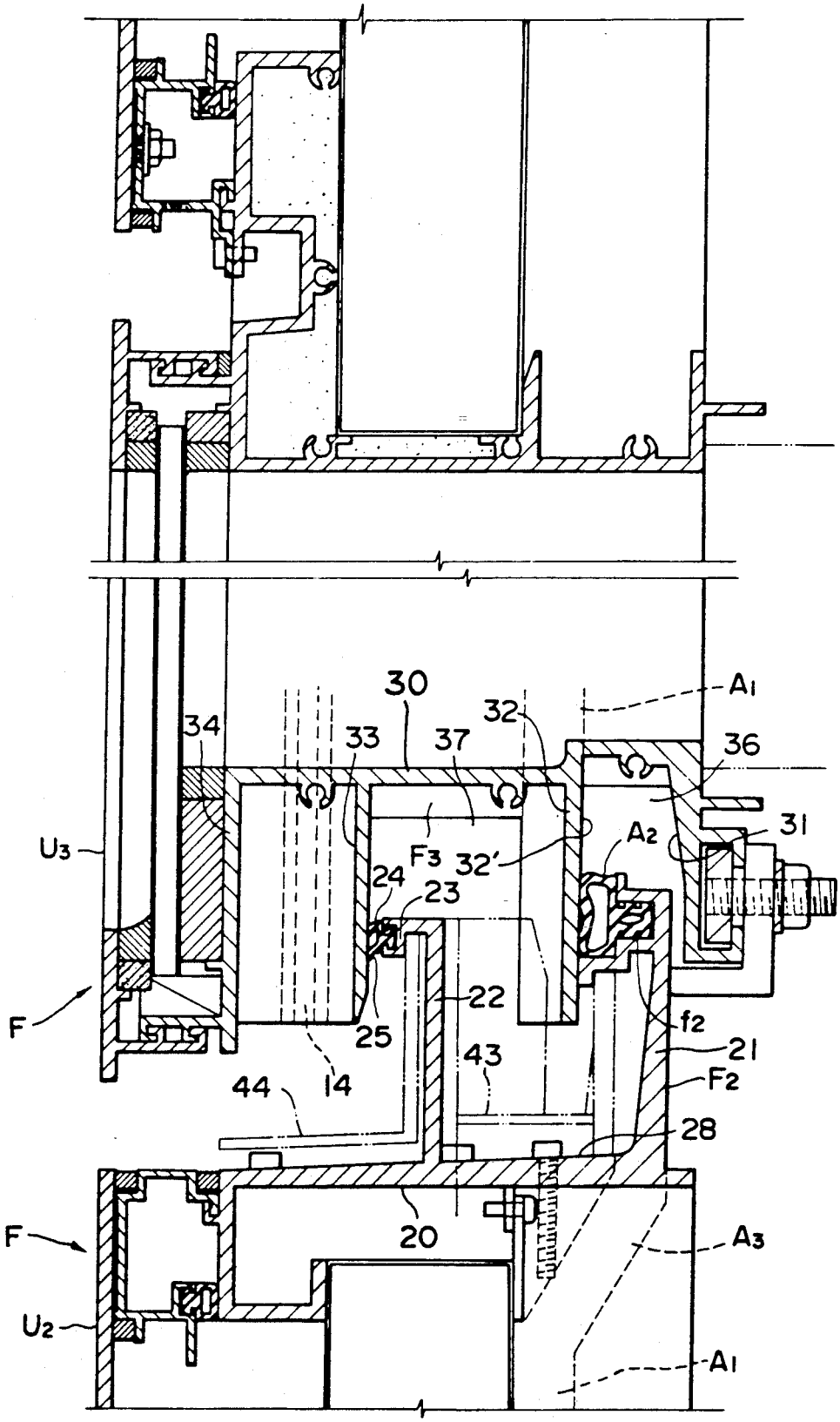
FIG. 5 is a vertical cross-sectional view of the two curtain wall units vertically adjacent to each other.

Referring to FIG. 5, the upper horizontal frame member F2 generally includes a horizontal base plate 20, an upstanding inner side wall 21 provided on the inner edge thereof and an upstanding outer side wall 22 provided on the middle thereof. The inner side wall 21 has along the upper edge thereof an upper horizontal channel f2 which is open outwardly. The outer side wall 22 has a horizontal segment 23 along the upper edge thereof. The horizontal segment 23 has at the distal edge a groove 24 which is open outwardly and receives a resilient sealing member 25. The inner and outer side walls 21, 22 define a gutter 28 with the portion of the base plate 20 interposed therebetween. As shown in FIG. 2, a drainage pipe 45 communicates with the bottom of the gutter 28 and the outer surface of vertical side frame member F1 to drain water from the gutter 28 to exterior.

The lower horizontal frame member F3 generally includes a horizontal base plate 30, an inner wall 31 provided along the inner edge thereof, a first middle wall 32 provided on the base plate 30 outwardly of the inner wall 31, a second middle wall 33 provided further outwardly of the first middle wall 32 and an outer wall 34 provided along the outer edge thereof, all the four vertical walls 31, 32, 33, 34 extending downwardly from the base plate 30. The inner wall 31 and the first middle wall 32 define a first gutter 36 therebetween and the first middle wall 32 and the second middle wall 33 define a second gutter 37.

A resilient weatherstrip A used in the weatherproof curtain wall unit U according to the present invention is of the prefabricated type and is a elongated resilient strip. As better shown in FIG. 1, the elongated resilient weatherstrip A comprises a pair of vertical strip portions A1, A1 fit in the respective vertical channels f1, f1, an upper horizontal strip portion A2 fit in the upper horizontal channel f2 and a pair of offset strip portions A3, A3 each integrally joining the vertical strip portion A1 and the upper horizontal strip portion A2. Each offset strip portion A1 is bent inwardly from the upper edge of the vertical channel f1, is guided around the guide stud 2 and extends to the horizontal strip portion A2.

Figure 3:
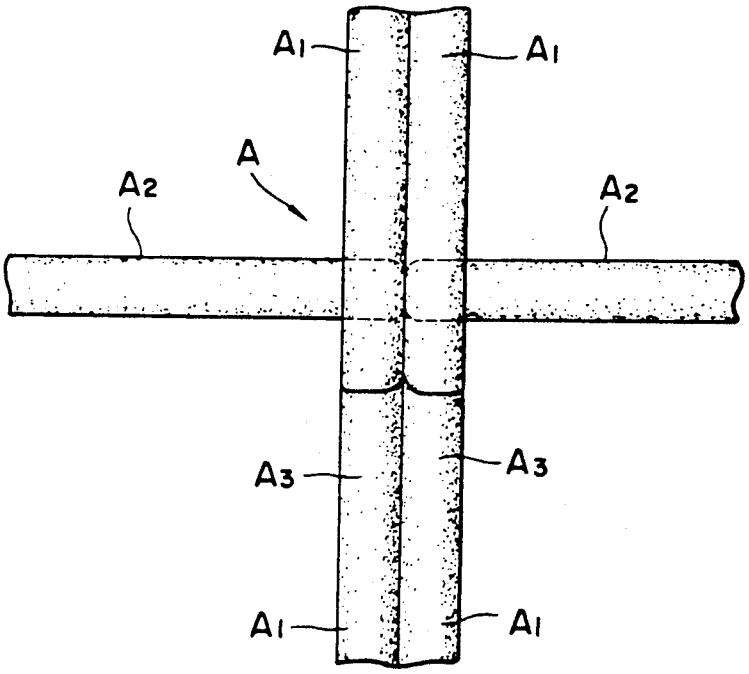
FIG. 3 is a schematic view showing the relative positions of resilient weatherstrips of the adjacent curtain wall units.

The weatherproof curtain wall units U according to the present invention are attached to a skeleton framework of the a building so as to be aligned vertically and horizontally one next to another and with respective outer surfaces lying flush with each other. FIG. 2 shows a juncture where the three adjacent curtain wall units U1, U2, U3 are joined together. FIG. 3 shows how the resilient weatherstrips A of the adjacent curtain wall units U1, U2, U3 are positioned relative to each other when the adjacent wall units U1, U2, U3 are joined together clearly by omitting other parts. As better shown in FIG. 3, each vertical strip portion A1 and offset strip portion A3 of the curtain wall unit U1 come into pressure engagement with the corresponding vertical strip portion A1 and offset strip portion A3 of the adjacent curtain wall unit U2.

As better shown in FIG. 5, the upstanding inner wall 21 of the curtain wall unit U1 is inserted into the gutter 36 of the upper curtain wall unit U3 with the upper horizontal strip portion A2 brought into pressure engagement with the inner surface 32' of the first middle wall 32. The lower ends of the opposed vertical strip portions A1, A1 of the upper curtain wall unit U3 fall within the gutter 28 beside the offset strip portion A3, A3 of the lower curtain wall unit U1 and come into pressure engagement with the opposite ends of the upper horizontal strip portion A2 of the lower curtain wall unit U1.

Now that the adjacent curtain wall units U are joined together with the resilient weatherstrips A arranged therebetween as described hereinabove, the curtain wall units U are completely weatherproof.

Furthermore, as better shown in FIG. 4, when the adjacent vertical side frame member F1, F1 of the adjacent curtain wall units U1, U2 are joined side-by-side to each other, the elongated ribs 13, 13 have their respective web portions disposed in parallel spaced relation to each other. The resilient elongated sealing strips 14, 14 on the opposed elongated ribs 13, 13 each come into pressure engagement with the opposed surface of the web portion of the other elongated rib 13. Still furthermore, as shown in FIG. 5, the sealing member 25 of the upper horizontal frame member F2 of the lower curtain wall unit U1 comes into pressure engagement with the inner surface of the second middle wall 33 of the lower horizontal frame member F3 of the upper curtain unit U3. These sealing strips 14, 14 and the sealing member 25 accomplish a primary sealing function to prevent rain from infiltrating through between the curtain wall units U1, U2, U3.

As shown in FIGS. 1 and 5, a water-guide block 43 is mounted on gutters 28, 28 at the juncture between the adjacent curtain wall units U1, U2 to guide water to both sides thereof and into the respective gutters 28, 28 of the adjacent curtain wall units U1, U2. Furthermore, a flashing 44 is mounted on the base plate 20 outwardly of the upstanding outer wall 22 at the juncture between the adjacent curtain wall units U1, U2 to prevent water from infiltrating through the juncture.

As clearly shown in FIG. 2, water collected in the gutter 28 of the upper horizontal frame member F2 is drained through the drainage pipe 45 to outside.

Although the resilient weatherstrip A is provided along the vertical side members F1, F1 and the upper horizontal member F2, that is, the three sides of the curtain wall unit U in the preceding embodiment, the resilient weatherstrip A may be provided continuously over the entire four sides thereof. Specifically, another or lower horizontal channel is provided on the inner surface of the first middle wall 32 in confronting relation to the upper horizontal channel f2 of the lower curtain wall unit U1. The resilient weatherstrip A further includes a lower horizontal strip portion contiguously extending from the opposed lower ends of the vertical strip portions A1, A1, which is fit into the lower horizontal channel. The lower horizontal strip portion comes into pressure engagement with the upper horizontal strip portion A2 of the lower curtain wall unit U1.

With the construction described hereinabove, a weatherproof curtain wall unit U according to the present invention only requires a resilient weatherstrip A in the form of a single elongated strip to ensure that the adjacent curtain wall units be completely weatherproof, that is, it utterly dispenses with additional devices which conventional curtain wall units would require.

Since the resilient weatherstrip A used in the weatherproof curtain wall unit U according to the present invention is of the prefabricated type, it wears very long, it is easy to attach to the curtain wall unit, and is high in weatherproofness. And, it advantageously dispenses with a separate step of sealing curtain wall units during the installation thereof at a construction site, thus rendering the installing time shorter.

Obviously, various modifications and variations of the present invention are possible in the light of the above teaching. It is therefore to be understood that within the scope of the appended claims the invention may be practiced otherwise than as specifically described.

What is claimed is:

1. A weatherproof curtain wall unit comprising:

(a) a rectangular frame having a pair of upper and lower horizontal frame members and a pair of vertical side frame members each connected at its opposite end with respective one ends of the upper and lower horizontal frame members to enclose a panel therein, each vertical side frame member having on its outside surface facing toward an adjacent curtain wall unit and outwardly of the inner edge thereof a vertical channel open toward the opposed vertical side frame member of the adjacent curtain wall unit, the vertical channel extending substantially throughout the length of the vertical side frame member but terminating slightly short of the upper end thereof, the upper horizontal frame member having on the inner edge thereof an upstanding inner side wall which in turn has on the upper edge thereof an upper horizontal channel open outwardly, the lower horizontal frame member having on the lower surface a vertical wall extending along and adjacent to the inner edge thereof; and (b) a weatherstrip being of a continuous elongate resilient strip and comprising a pair of vertical strip portions fit in the respective vertical channels, a horizontal strip portion fit in the horizontal channel and a pair of offset portions each integrally joining the vertical strip portion and the horizontal strip portion; when the curtain wall unit is joined to curtain wall units adjacent horizontally and vertically thereto, each vertical strip portion and offset strip portion of the curtain wall unit coming into pressure engagement with the corresponding vertical strip portion and offset strip portion of the adjacent curtain wall unit and the horizontal portion of the unit curtain wall unit coming into pressure engagement with the inner surface of the vertical wall of the upper curtain wall unit.

2. A weatherproof curtain wall unit according to claim 1, the vertical side frame member further including a protuberant guide stud provided contiguously on the upper end of the vertical channel and intermediate between the vertical channel and the inner edge of the vertical side frame member, each offset strip portion being bent inwardly from the upper edge of the vertical channel, guided around the guide stud and extending to the horizontal strip portion.

3. A weatherproof curtain wall unit according to claim 1, the vertical side frame member further including an elongated rib provided longitudinally on the outside surface adjacent to the outer edge thereof and protruding perpendicularly therefrom toward the adjacent curtain wall unit, the elongate rib being coextensive to the vertical channel, the elongated rib having a resilient elongated sealing strip provided on one side and adjacent to the distal end thereof; the elongated rib being disposed in parallel spaced relation to the corresponding elongated rib of the adjacent curtain wall unit with the resilient sealing strip of the elongated rib brought into pressure engagement with the opposed surface of the corresponding elongated rib of the adjacent curtain wall unit, when the adjacent curtain wall units are joined to each other.

4. A weatherproof curtain wall unit according to claim 1, the upper horizontal frame member further including an upstanding outer side wall which in turn has a horizontal segment along the upper edge thereof, the horizontal segment having at the distal edge a groove which is open outwardly and receives a resilient sealing member, the lower horizontal frame member having another vertical wall on its lower surface outwardly of the first-mentioned vertical wall, so that, when the upper and lower curtain wall units are joined to each other, the resilient sealing member of the lower curtain wall unit comes into pressure engagement with the inner surface of the vertical wall.

* * * * *